US008073346B2

(12) United States Patent
Sakai et al.

(10) Patent No.: US 8,073,346 B2
(45) Date of Patent: Dec. 6, 2011

(54) IMAGE FORMING APPARATUS CONFIGURED TO USE A CARTRIDGE INCLUDING MEMORY AND A CARTRIDGE WITHOUT MEMORY

(75) Inventors: Hiroyuki Sakai, Saitama (JP); Shinji Yoshida, Saitama (JP); Yasuhiko Otawa, Saitama (JP); Miho Sasaki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/710,071

(22) Filed: Feb. 22, 2010

(65) Prior Publication Data

US 2010/0329700 A1 Dec. 30, 2010

(30) Foreign Application Priority Data

Jun. 25, 2009 (JP) ..... P2009-151417

(51) Int. Cl.
*G03G 15/00* (2006.01)

(52) U.S. Cl. ..... 399/13

(58) Field of Classification Search ..... 399/9, 12, 399/13, 24, 25, 31, 107, 110, 111
See application file for complete search history.

(56) References Cited

U.S. PATENT DOCUMENTS 7,463,835 B2 * 12/2008 Harumoto ..... 399/12
7,885,553 B2 * 2/2011 Otawa et al. ..... 399/12

FOREIGN PATENT DOCUMENTS

JP A-10-207323 8/1998
JP A-2008-76423 4/2008

* cited by examiner

*Primary Examiner* — Hoan Tran
(74) *Attorney, Agent, or Firm* — Oliff & Berridge, PLC

(57) ABSTRACT

According to an aspect of the invention, an image forming apparatus includes an image forming unit, a first detecting unit, a second detecting unit, a control unit. The image forming unit forms an image on a recording medium by using coloring materials of a plurality of colors based on image information. The first detecting unit detects whether or not the first given number of the first housing units are installed to the apparatus. The second detecting unit detects whether or not the second given number of the second housing unit and the third given number of the first housing unit are installed to the apparatus.

9 Claims, 10 Drawing Sheets

IMAGE FORMING APPARATUS CONFIGURED TO USE A CARTRIDGE INCLUDING MEMORY AND A CARTRIDGE WITHOUT MEMORY

CROSS-REFERENCE TO RELATED APPLICATIONS

This application is based upon and claims priority under 35 USC 119 from Japanese Patent Application No. 2009-151417, filed Jun. 25, 2009.

BACKGROUND

1. Technical Field

The present invention relates to an image forming apparatus.

2. Related Art

Recently, in image forming apparatuses such as printers, in order to decrease the costs thereof, there are many cases where a memory (hereinafter, referred to as a CRUM) that stores information on toner or the like is not built in a toner cartridge as a bundled expendable item of the image forming apparatus at the time of shipment.

In such a case, when the toner of the bundled toner cartridge is consumed, a user purchases a toner cartridge that is available in the market or the like.

In the toner cartridge purchased by the user, the CRUM is built. Accordingly, a control process for the printer side should be configured to be able to use both a toner cartridge not having a CRUM and a toner cartridge having a CRUM.

Therefore, there is a request for checking whether all the toner cartridges are installed at low cost in the state in which image formation can be performed. Accordingly, various technologies have been proposed.

SUMMARY OF THE INVENTION

According to an aspect of the invention, an image forming apparatus includes an image forming unit, a first detecting unit, a second detecting unit, a control unit. The image forming unit forms an image on a recording medium by using coloring materials of a plurality of colors based on image information. The first detecting unit detects, when a first given number of the first housing units are used for the apparatus, whether or not the first given number of the first housing units are installed to the apparatus. The second detecting unit detects, when a second given number of second housing unit and a third given number of the first housing unit are used for the apparatus, whether or not the second given number of the second housing unit and the third given number of the first housing unit are installed to the apparatus. The control unit controls the image forming unit to form the image when the first detecting unit detects an installation of the first housing units or the second detecting unit detects an installation of the first housing units and the second housing unit. The first housing units house the coloring materials. The second housing units respectively house the coloring materials. The each of the second housing unit includes a storing module storing information on the stored coloring material.

BRIEF DESCRIPTION OF THE DRAWINGS

Exemplary embodiments of the invention will be described in detail based on the following figures, wherein.

DETAILED DESCRIPTION

Hereinafter, exemplary embodiments of the present invention will be described with reference to drawings. In the accompanying drawings, the same reference signs will be used throughout to designate the same components, and duplicate description thereof is be omitted. In addition, the description here is for preferred embodiments of the present invention. Thus, the present invention is not limited thereto.

First Embodiment

Hereinafter, an image forming apparatus PR1 according to a first embodiment of the present invention will be described with reference to FIGS. 1 to 7.

The image forming apparatus PR1 is not particularly limited. Thus, the image forming apparatus PR1 may be configured as a laser printer, a full-color printer, an ink-jet type printer, a facsimile apparatus, a multi-function apparatus, or the like.

In this embodiment, the image forming apparatus PR1 is assumed to be configured as a full-color printer.

In addition, the coloring material of the image forming apparatus PR1 according to this embodiment is toner, and first containers (an example of first housing means) as expendable items that individually house toner corresponding to colors including Y (yellow), M (magenta), C (cyan), and K (black) are assumed to be first toner cartridges 301Y, 301M, 301C, and 301K.

In addition, the first toner cartridges 301Y, 301M, 301C, and 301K are toner cartridges as bundled expendable items of the image forming apparatus PR1 at the time of shipment, and any CRUM that stores information on the toner and the like are assumed not to be built in the toner cartridges.

When the first toner cartridges 301Y, 301M, 301C, and 301K, which are bundled expendable items of the image forming apparatus PR1 at the time of shipment, are consumed, the first toner cartridges are replaced by a user with second toner cartridges 401Y, 401M, 401C, and 401K, which are available in the market or the like.

Figure 1:
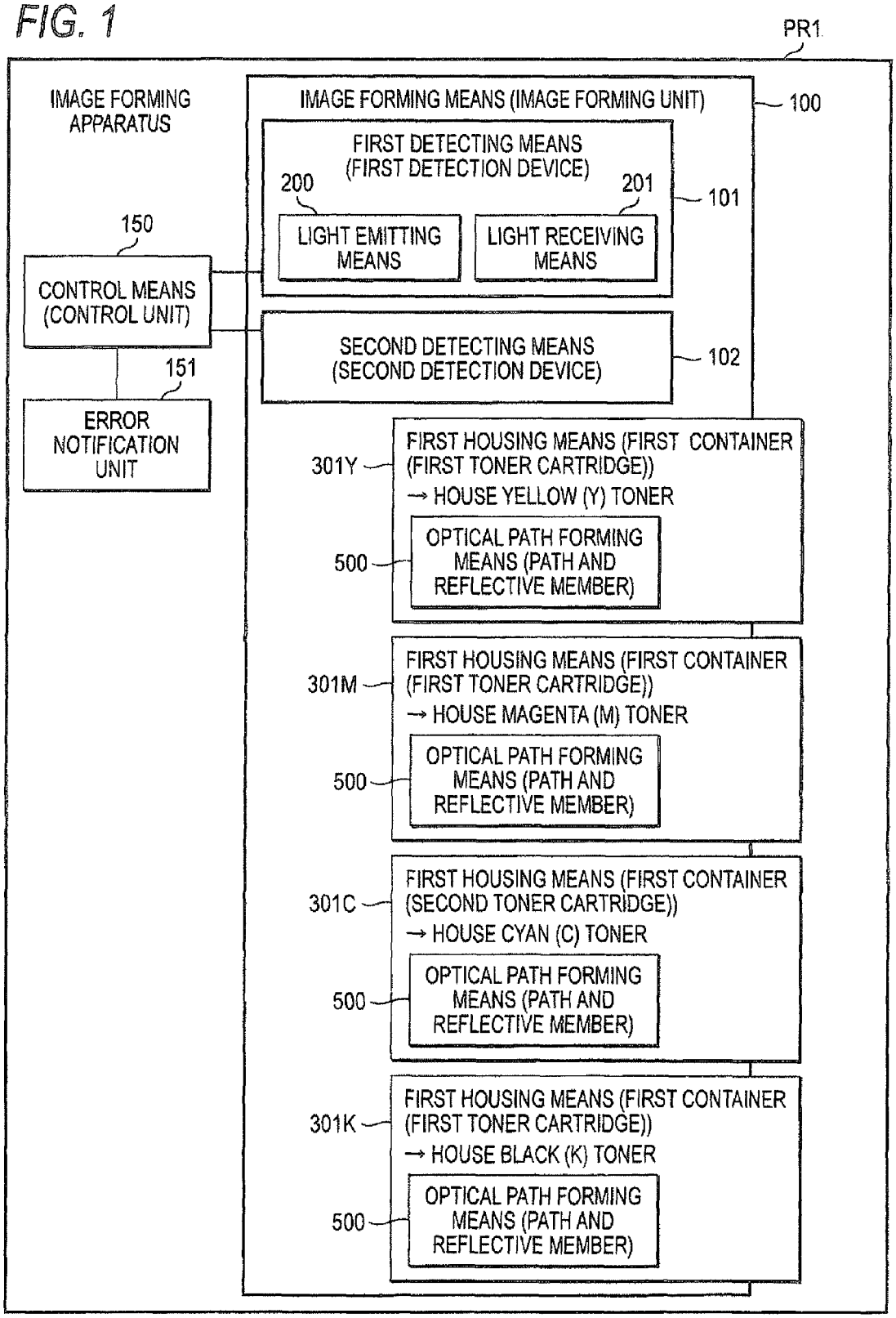
FIG. 1 is a functional block diagram representing the configuration of an image forming apparatus PR1 according to the first embodiment 1.
Figure 2:
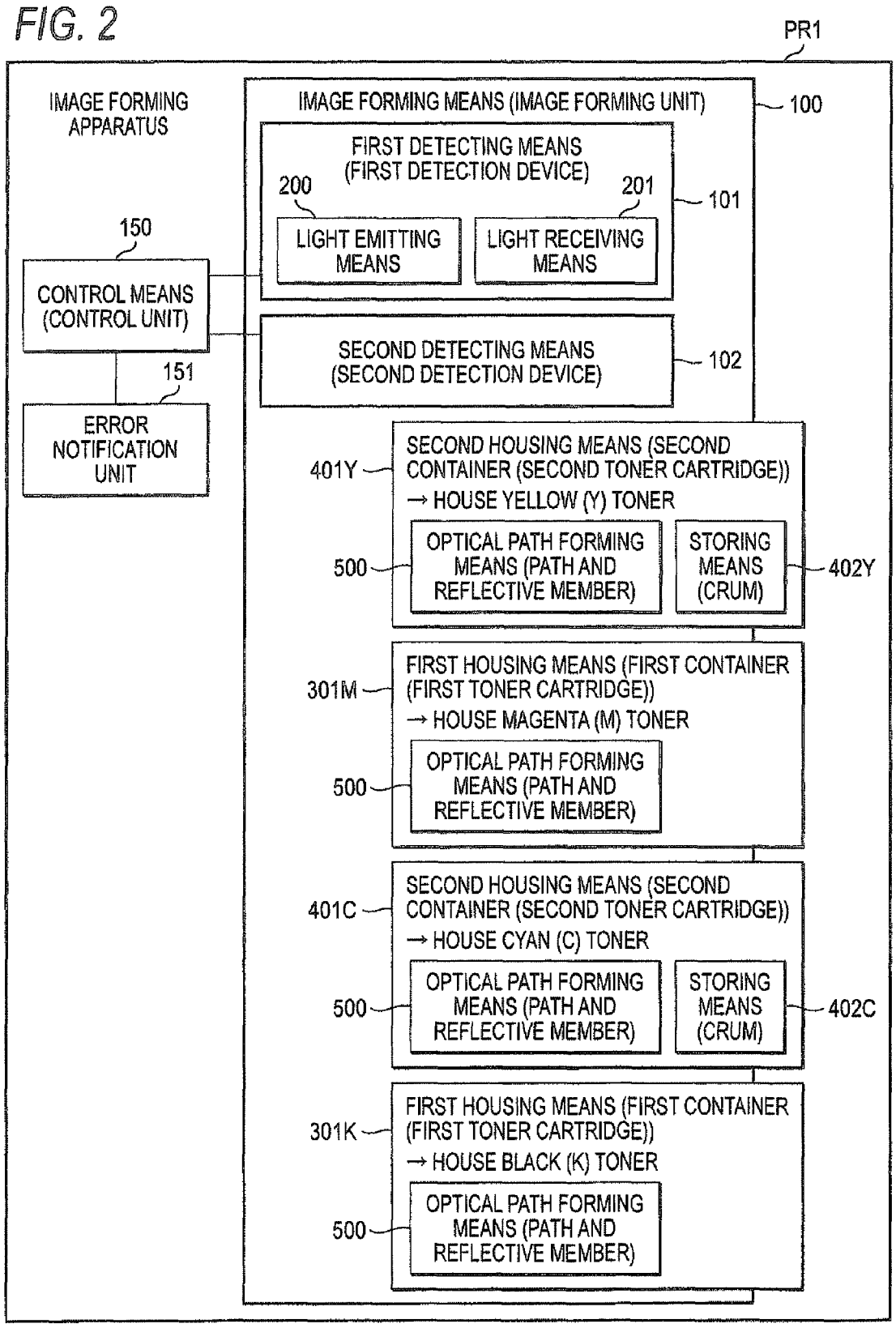
FIG. 2 is a functional block diagram representing a different state of the configuration of an image forming apparatus PR1 according to the first embodiment.

The second toner cartridges 401Y, 401M, 401C, and 401K, as partially shown in FIG. 2, include the CRUMs 402Y, 402M, 402C, and 402K (an example of storing means) that store information on the toner and second image information therein.

The information on the toner is not particularly limited. For example, the information on the toner includes historical information such as environmental historical information including the temperature, the humidity, or the like of the surroundings of the cartridge and use historical information including the number of sheets printed by using the cartridge or the like.

The CRUMs 402Y, 402M, 402C, and 402K are configured by non-volatile memories such as EEPROMs.

The communication method between the CRUMs 402Y, 402M, 402C, and 402K and a controller (not shown) of the main body of the image forming apparatus PR1 is not particularly limited. For example, a wireless method or a wired method may be used as the communication method.

In addition, when the wireless method is used, a process of acquiring wireless authentication is needed in each country.

The image forming apparatus PR1 includes an image forming unit 100 (an example of image forming means) that is installed such that the first toner cartridges 301Y, 301M, 301C, and 301K or the second toner cartridges 401Y, 401M, 401C, and 401K are detachably attached thereto and forms an image on a printing sheet (an example of a recording medium) based on image information by using toner, a first detection device 101 (an example of first detecting means) that detects whether all the needed first toner cartridges 301Y, 301M, 301C, and 301K are installed in a case where only the first toner cartridges are used, a second detection device 102 (an example of second detecting means) that detects whether all the needed first and second toner cartridges are installed in a case where the first toner cartridges 301Y, 301M, 301C, and 301K and the second toner cartridges 401Y, 401M, 401C, and 401K are used in a mixed manner (for example, a case corresponding to the case shown FIG. 2), a control unit 150 (an example of control means) that is configured by a microcomputer or the like controlling the image forming unit 100 to perform image formation in a case where installation of the needed first and second toner cartridges 301Y to 301K and 401Y to and 401K is detected in the first detection device 101 or the second detection device 102, and an error notification unit 151 that reports the error state through sound or display in a case where an error is determined in the installation state of the first toner cartridges 301Y to 301K or the second toner cartridges 401Y to 401K based on the result of detection performed by the first detection device 101 or the second detection device 102.

In addition, each of the first toner cartridges 301Y, 301M, 3010, and 301K includes a path 500*a* and a reflective member 500*b* (an example of optical path forming means) that delivers light, in a case where the first toner cartridges 301Y, 301M, 3010, and 301K are installed in a predetermined arrangement (the arrangement of YMCK from the upper side in FIG. 1), from one end side to the other end side of the arrangement.

Then, the first detection device 101 detects whether light is transmitted from one end side to the other end side of the arrangement of the first toner cartridges 301Y, 301M, 301C, and 301K through an optical path L1 (L2) that is formed by the optical path forming means 500. The control unit 150 controls whether it is possible to form an image based on the result of detection performed by the first detection device 101.

In addition, the second detection device 102 is configured by a detection device of a wired type or a wireless type that detects the mixed state of the first toner cartridges 301Y to 301K and the second toner cartridges 401Y to 401K by a wired or a wireless communication in a case where the transmission of light is not detected by the first detection device 101. The control unit 150 controls whether or not to form an image based on the result of detection performed by the second detection device 102.

In addition, the first detection device 101 includes an LED 200 (an example of light emitting means) or the like that emits light such that light is incident to the optical path L1 (L2) from one end side of the arrangement of the first toner cartridges 301Y to 301K and a photo transistor (an example of light receiving means) 201 or the like that receives light output from the optical path positioned on the other end side of the arrangement of the first toner cartridges 301Y to 301K.

Figure 3:
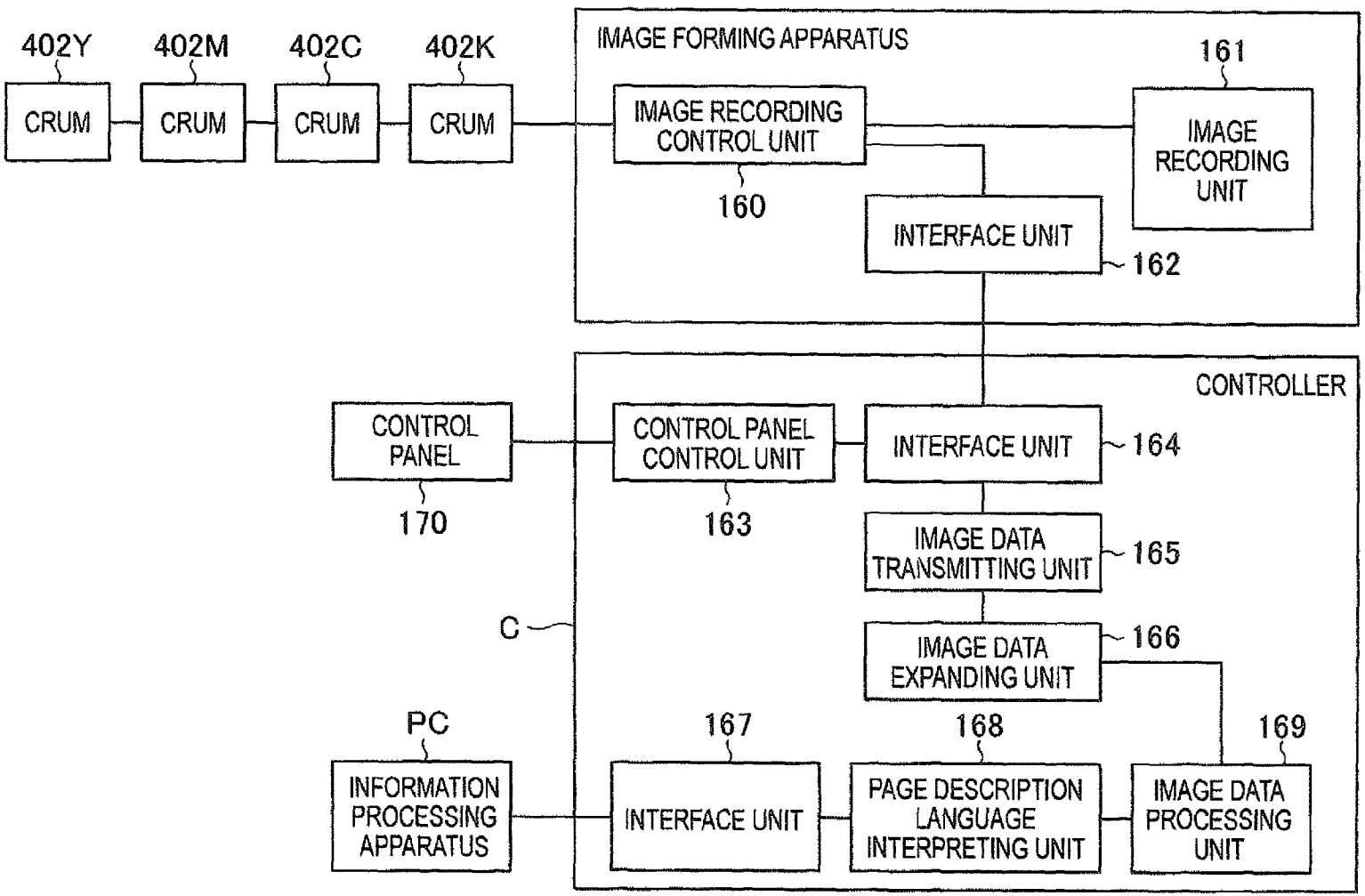
FIG. 3 is a block diagram representing the configuration of an image forming apparatus PR1 according to the first embodiment.

As shown in the block diagram of FIG. 3, the image forming apparatus PR1 according to this embodiment additionally includes: an image recording control unit 160 that is connected to the CRUMs 402Y to 402K; an image recording unit 161 that records image data; interface units 162 and 164 that connect the controller C and the main body to each other; a control panel control unit 163 that controls a control panel 170 performing error display or the like; an image data transmitting unit 165 that transmits the image data; an image data expanding unit 166; an interface unit 167 that performs connection with an information processing apparatus PC configured by a personal computer or the like that performs error display or the like; a page description language interpreting unit 168 that interprets a page description language; an image data processing unit 169 that performs various processes for the image data; and the like.

Figure 4:
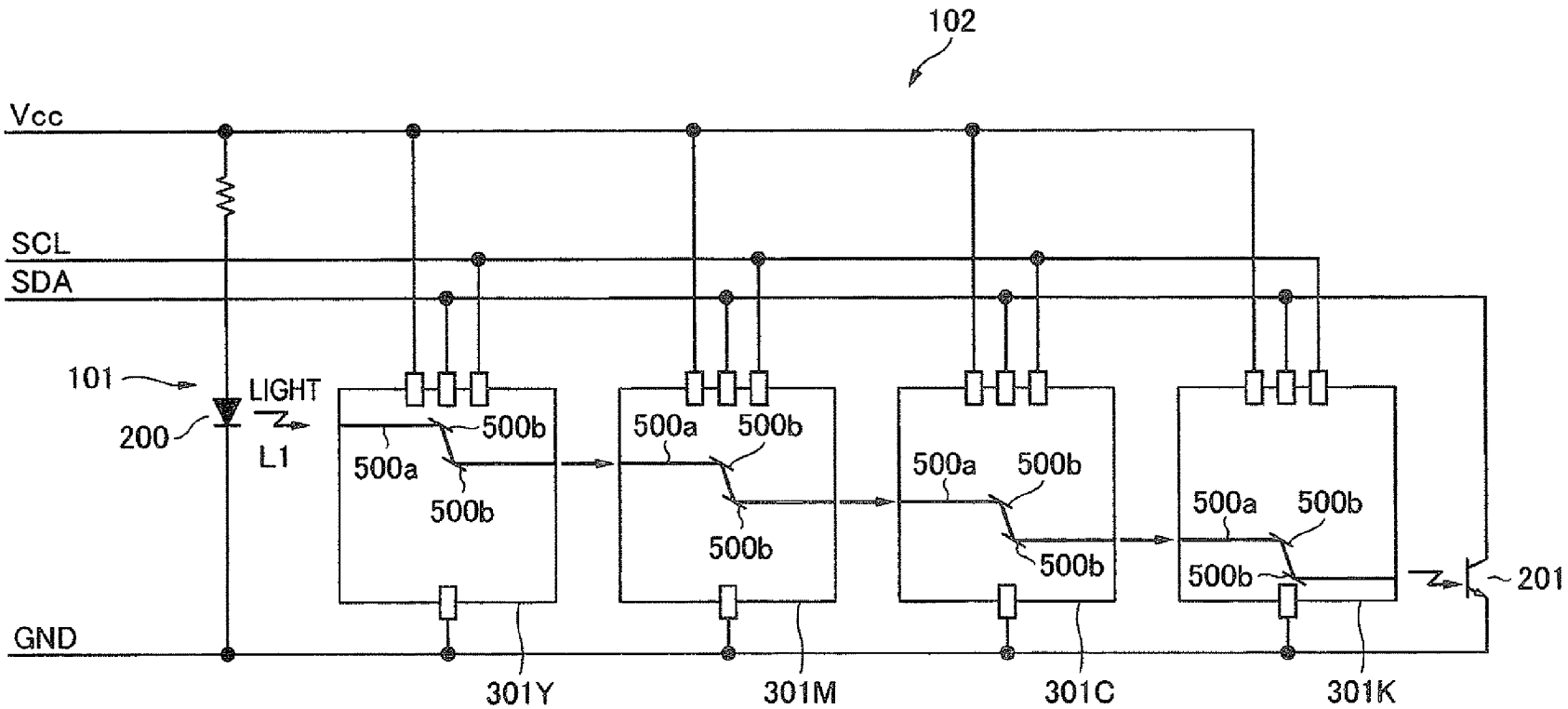
FIG. 4 is an explanatory diagram representing an example of a detection state of toner cartridges.

Next, FIG. 4 shows a detection example for a case where only the first toner cartridges 301Y, 301M, 301C, and 301K are installed to the image forming unit 100.

In such a case any toner cartridge does not have a CRUM built therein. Accordingly, detection is not performed by using the wired-type second detection device 102 through the CRUMs 402Y to 402K, but detection is performed by using an optical-type first detection device 101.

Here, the optical path L1 is formed by the path 500*a* and the reflective member 500*b* that are included in each of the first toner cartridges 301Y, 301M, 301C, and 301K.

In a case where the optical path L is formed in the shape of a simple straight line, a light ray emitted from the light emitting means 200 is transmitted up to the light receiving means 201 even in a case where any one of the first toner cartridges 301Y to 301K is not placed. Accordingly, placement of the first toner cartridges 301Y to 301K cannot be determined. For example, as shown in FIG. 4, the dispositions of the reflective members 500*b* are configured to be different from one another in the first toner cartridges 301Y, 301M, 3010, and 301K. Accordingly, only in a case where the first toner cartridges 301Y, 301M, 301C, and 301K are installed in the arrangement of YMCK from the left side in FIG. 4, the paths 500*a* are optically connected together, and thereby the optical path L is formed from the light emitting means 200 to the light receiving means 201.

Accordingly, the installation of the first toner cartridges 301Y, 301M, 301C, and 301K as the bundled expendable items of the image forming apparatus PR1 at the time of shipment is detected without increasing the costs.

Figure 5:
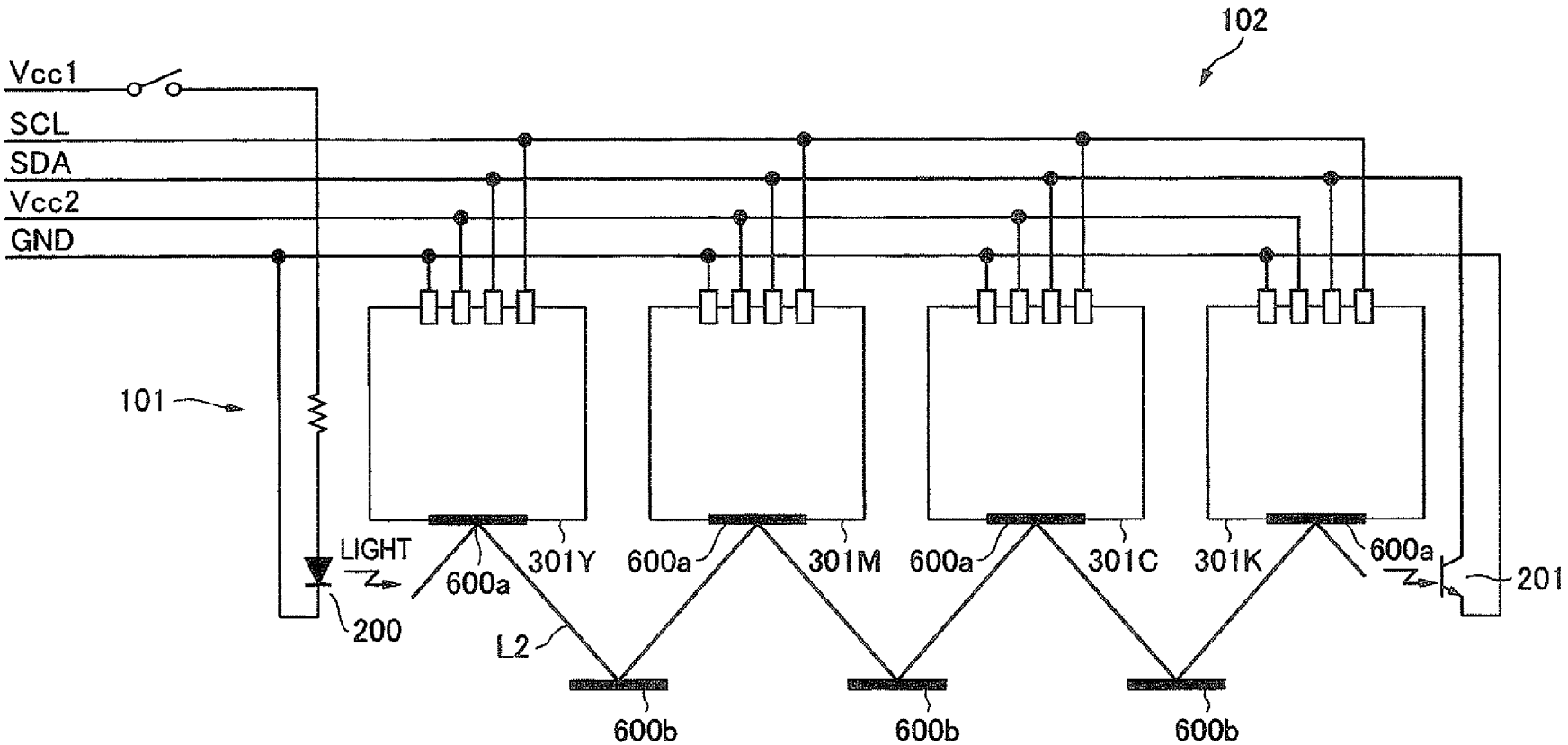
FIG. 5 is an explanatory diagram representing another example of the detection state of the toner cartridges.

In the configuration example shown in FIG. 5, the optical path L2 is configured by a combination of a first reflective member 600*a* disposed in a part of each of the first toner cartridges 301Y, 301M, 301C, and 301K and a second reflective member 600*b* disposed on the apparatus side.

Accordingly, the installation of the first toner cartridges 301Y, 301M, 301C, and 301K as the bundled expendable items of the image forming apparatus PR1 at the time of shipment is detected without increasing the costs.

Next, as shown in FIG. 2, detection of the state in which the first toner cartridges 301Y to 301K and the second toner cartridges 401Y to 401K are placed in a mixed manner will be described with reference to FIG. 6.

Figure 6:
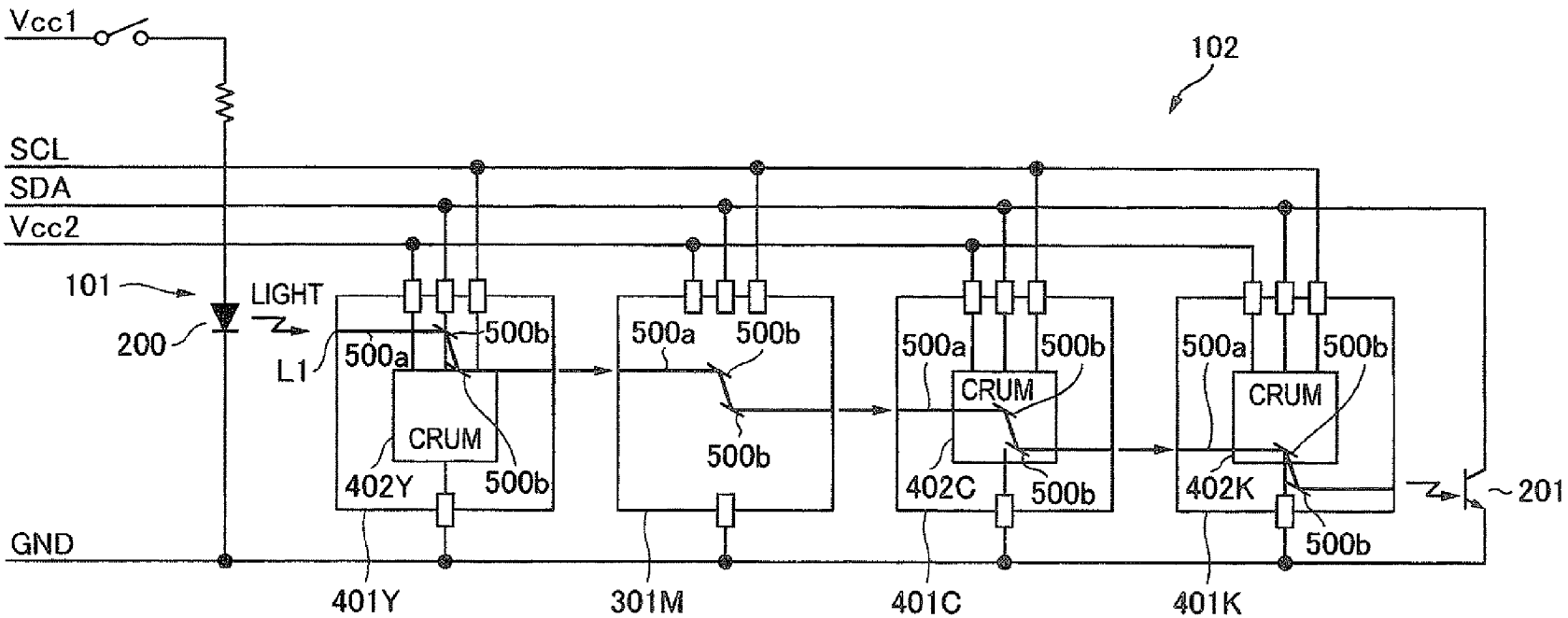
FIG. 6 is an explanatory diagram representing another example of the detection state of the toner cartridges.

In the example shown in FIG. 6, in a second position from the left side, the first toner cartridge 301M that does not have a CRUM is installed. In addition, in other positions, the second toner cartridges 401Y, 401C, and 401K that respectively have CRUMs 402Y, 402C, and 402K are installed.

In such a case, the placement of the CRUMs 402Y, 402C, and 402K are detected by the second detection device 102. However, it cannot be determined whether a printable toner cartridge is placed in the second position from the left side.

On the other hand, the optical path L1 is formed in the second toner cartridges 401Y to 401K as well by arranging the optical path forming means 500 (a combination of the path 500*a* and the reflective member 500*b* in the example shown in FIG. 4, and a combination of the first reflective member 600*a* disposed on the toner cartridge side and the second reflective member 600*b* disposed on the apparatus side in the example shown in FIG. 5) that is the same as that of the first toner cartridges 301Y to 301K. Accordingly, the installation of the first toner cartridges 301Y to 301K and the second toner cartridges 401Y to 401K that are in a printable state is optically detected.

Accordingly, the installation of the first toner cartridges 301Y to 301K or the second toner cartridges 401Y to 401K as the bundled expendable items of the image forming apparatus PR1 at the time of shipment is detected without increasing the costs.

In a case where only the second toner cartridges 401Y, 401M, 401C, and 401K are installed, although not shown in the figure, only by performing detection by using the second detection device 102 through the CRUMs 402Y, 402M, 402C, and 402K, the installation state of the printable second toner cartridges 401Y, 401M, 401C, and 401K is determined.

Figure 7:
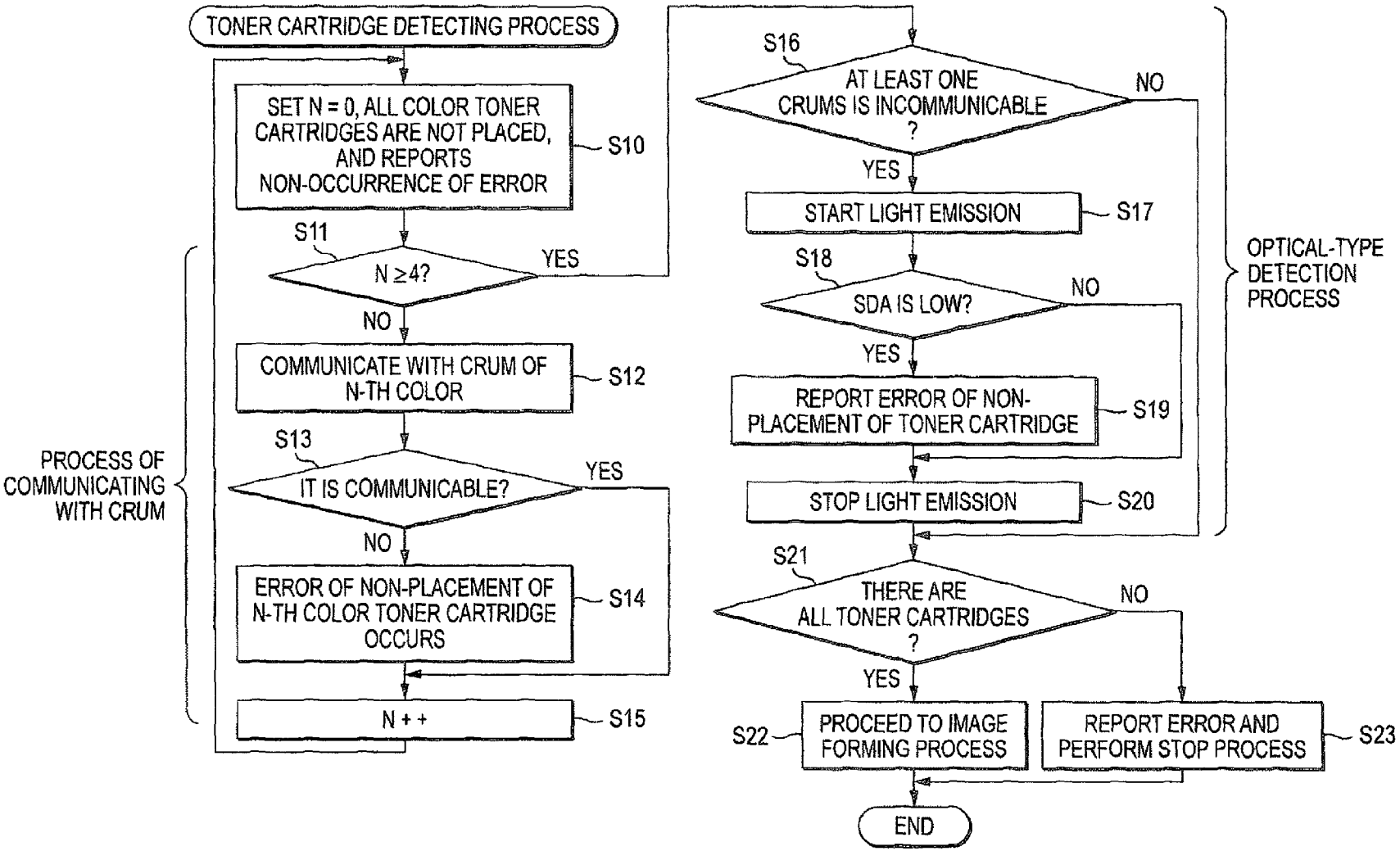
FIG. 7 is a flowchart representing the processing sequence of a toner cartridge detecting process.

Next, an example of the processing sequence of the toner cartridge detecting process of the image forming apparatus PR1 will be described with reference to the flowchart shown in FIG. 7.

When this process is started, first in Step S10, N (here, N is an integer) is set to zero. Then, since all the cartridges are not installed, no occurrence of error is reported, and the process proceeds to Step S11.

In Step S11, it is determined whether N is equal to or greater than four. In the case of "Yes", the process proceeds to Step S16. On the other hand, in the case of "No", the process proceeds to Step S12.

In Step S12, communication with a CRUM of a color corresponding to the N-th color is made (for example, in the case of N=1, communication with the CRUM 402Y of the second toner cartridge 401Y corresponding to yellow (Y) is tried).

In Step S13, it is determined whether the CRUM are communicable. In the case of "No", the process proceeds to Step S14, an error of no placement of the second toner cartridge corresponding to the N-th time occurs, and the process proceeds to Step S15.

On the other hand, in the case of "Yes" in Step S13, the process directly proceeds to Step S15.

In Step S15, N is incremented by one, and the process proceeds back to Step S11.

In Step S16, it is determined whether at least one of the CRUMs 402Y, 402M, 4020, and 402K is incommunicable. Then, in the case of "No", the process proceeds to Step S21. On the other hand, in the case of "Yes", the process proceeds to Step S17. Specifically, "YES" in Step S16 means one error in Step S14 occurred.

In Step S17, light emission of the light emitting means 200 of the first detection device 101 is started, and the process proceeds to Step S18.

In Step S18, it is determined whether a signal SDA represented in FIG. 4 or 5 is low. Then, in the case of "No", the process proceeds to Step S20. On the other hand, in the case of "Yes", the process proceeds to Step S19, no error of the toner cartridge is reported, and the process proceeds to Step S20.

In addition, in the determination on the signal SDA in Step S18, the signal SDA may be determined whether or not to be high depending on the characteristics or the like of the light emitting means 200.

In Step S20, the light emission of the light emitting means 200 of the first detection device 101 is stopped, and the process proceeds to Step S21.

In Step S21, it is determined whether all the toner cartridges (the first toner cartridges 301Y to 301K or the second toner cartridges 401Y to 401K) are placed. Then, in the case of "Yes", the process proceeds to an image forming process under the control of the control unit 150. On the other hand, in the case of "No", the process proceeds to Step S23, the occurrence of error is reported by using the error notification unit 151, and a process of stopping the apparatus is performed so as to complete the process.

In the above-described flowchart, the detection, which is performed by the second detection device 102, is performed first. However, the detection performed by the first detection device 101 may be configured to be performed first. In other words, it may be configured that the optical detection process is performed first by the first detection device 101, communication with the CRUMB 402Y to 402K is performed by the second detection device 102 at a time point when installation of all the toner cartridges is checked, and any of the second toner cartridges 401Y to 401K is checked.

Second Embodiment

An image forming apparatus PR2 according to a second embodiment of the present invention will be described with reference to FIGS. 8 and 9.

The same reference sign is assigned to a configuration that is the same as that of the image forming apparatus PR1 according to the first embodiment, and duplicate description thereof is omitted.

Figure 8:
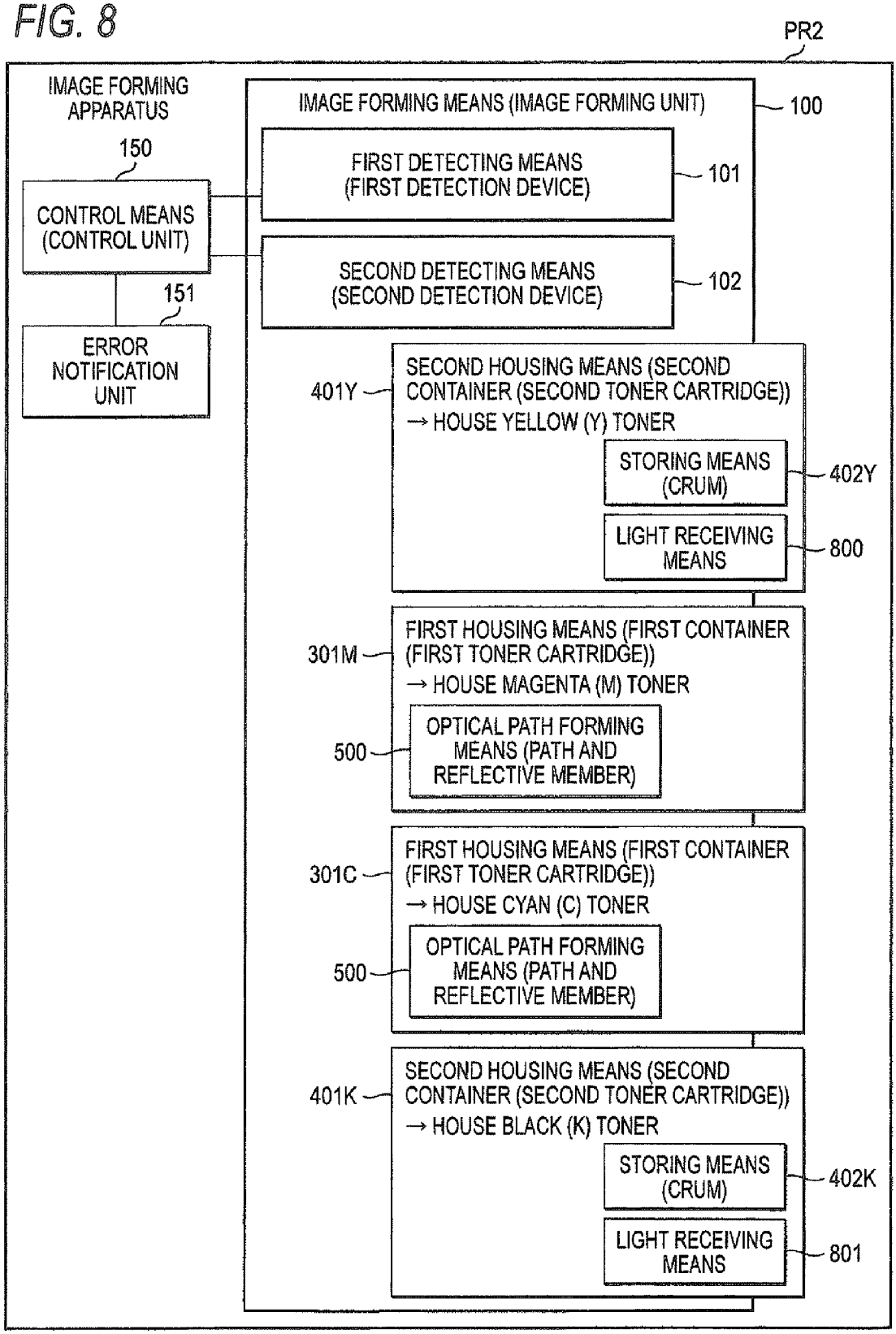
FIG. 8 is a functional block diagram representing the configuration of an image forming apparatus PR2 according to the second embodiment.

As can be noticed by referring to FIG. 8, the image forming apparatus PR2 according to the second embodiment is different from the image forming apparatus PR1 according to the first embodiment. Thus, in the arrangement of the first toner cartridges 301Y to 301K or the second toner cartridges 401Y to 401K, one of the first toner cartridge 301Y to 301K or one of the second toner cartridge 401Y to 401K to be disposed on one end side has light emitting means 800 such as an LED that emits light such that the light is incident to an optical path of another first toner cartridge 3011 to 301K or another second toner cartridge 401Y to 401K located adjacent to the one of the first toner cartridges 301Y, 301M, 301C or 301K or the one of the second toner cartridges 401Y, 401M, 401C, or 401K.

In addition, in the arrangement of the first toner cartridges 301Y to 301K or the second toner cartridges 401Y to 401K, one of the first toner cartridge 3011 to 301K or one of the second toner cartridge 4011 to 401K to be disposed on the other end side has light receiving means 801 such as a photo transistor that receives light output from the optical path of another first toner cartridge 3011, 301M, 301C, or 301K or another second toner cartridge 4011, 401M, 401C, or 401K located adjacent to the one of the first toner cartridge 3011 to 301K or the one of the second toner cartridge 401Y to 401K.

Figure 9:
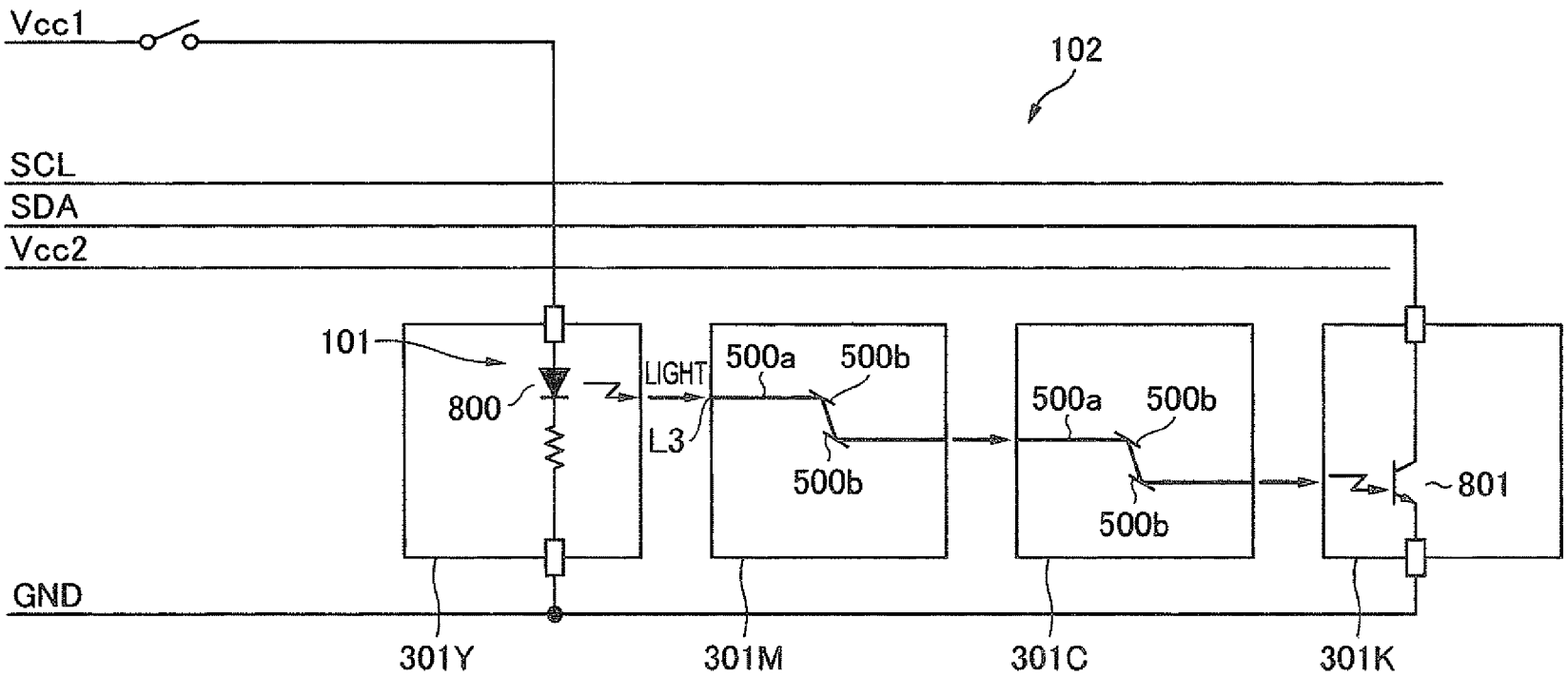
FIG. 9 is an explanatory diagram representing an example of the detection state of toner cartridges.

FIG. 9 shows a concrete example of the detection state of the toner cartridge.

In the example shown in FIG. 9, in the arrangement in which YMCK are arranged from the left side, the first toner cartridge 301Y that has the light emitting means 800 is installed at the position of 1, the first toner cartridges 301M and 301C having the optical path forming means 500 (the path 501*a* and the reflective member 500*b*) are installed to the positions of M and C, and the first toner cartridge 301K having the light receiving means 801 is installed to the position of K.

Accordingly, the light emitted from the light emitting means 800 of the first toner cartridge 301Y is received by the light receiving means 801 included in the first toner cartridge 301K through an optical path L3 formed by the first toner cartridges 301M and 301C. Accordingly, the installation of the first toner cartridges 301Y to 301K is detected.

Although not shown in the figure, in a case where the first toner cartridges 301Y to 301K and the second toner cartridges 401Y to 401K are placed in a mixed manner, similar to the case of the first image forming apparatus PR1, the installation state is recognized based on the result of detection performed by the first detection device 101 and the second detection device 102.

As described above, according to this embodiment, since the light emitting means 800 and the light receiving means 801 are disposed on the side of the first toner cartridges 301Y to 301K or the second toner cartridges 401Y to 410K, the cost of the apparatus is further reduced.

The present invention invented by the inventor thereof has been described in detail based on the embodiments. However, the invention should not be construed as being limited to the technologies disclosed in the embodiments. Thus, the embodiments disclosed here should be construed as examples in every aspect. In other words, the technical scope of the present invention is not construed to be limited based on the description of the above-described embodiments. Thus, the technical scope should be construed in accordance with the description of claims and includes technologies equivalent to the technologies described in the claims and all the changes made within the scope of the claims.

Figure 10:
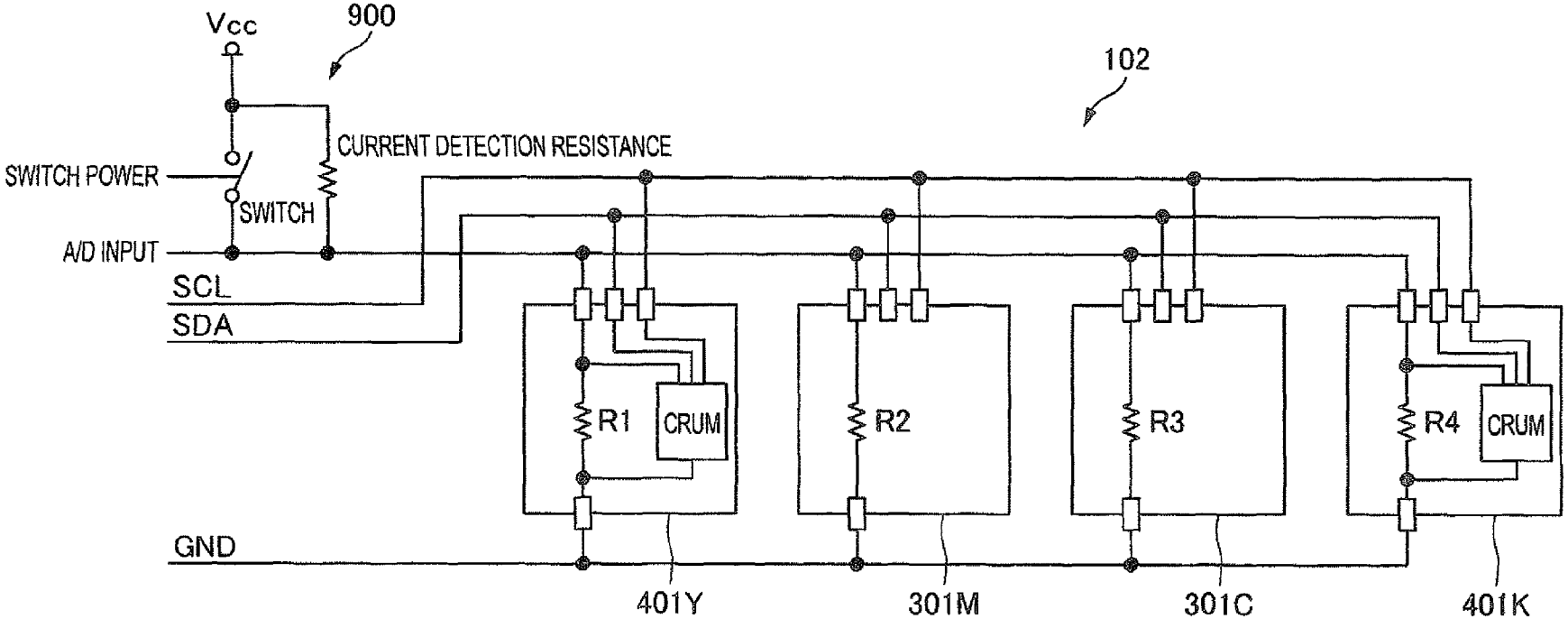
FIG. 10 is an explanatory diagram representing another example of the detection state of the toner cartridges.

For example, the installation state of the first toner cartridges 301Y to 301K or the second toner cartridges 401Y to 401K may be configured to be detected, as shown in FIG. 10, by mounting resistors R1, R2, R3, and R4 having different resistance values for YMCK in the first toner cartridges 301Y to 301K or the second toner cartridges 401Y to 401K and detecting the resistance values of the resistors R1, R2, R3, and R4 by using a detection device 900.

INDUSTRIAL APPLICABILITY

The image forming apparatus according to the present invention can be applied to a printer, a multi-function apparatus, a facsimile apparatus, and the like.

What is claimed is:

1. An image forming apparatus comprising:

an image forming unit that forms an image on a recording medium by using coloring materials of a plurality of colors based on image information;

a first detecting unit that detects, when a first given number of first housing units are used for the apparatus, whether or not the first given number of the first housing units are installed to the apparatus;

a second detecting unit that detects, when a second given number of second housing units and a third given number of the first housing units are used for the apparatus, whether or not the second given number of the second housing units and the third given number of the first housing units are installed to the apparatus; and a control unit that controls the image forming unit to form the image when the first detecting unit detects an installation of the first housing units or the second detecting unit detects an installation of the first housing units and the second housing units, wherein the first housing units house the coloring materials, the second housing units respectively house the coloring materials, each of the second housing units includes a storing module storing information on the stored coloring material, each of the first housing units and each of the second housing units respectively include an optical path forming portion that forms an optical path to transmit light from one end to the other end of a predetermined arrangement when the first housing units and the second housing units are installed to the apparatus in the predetermined arrangement, the first detecting unit detects whether or not the light is transmitted from the one end to the other end through the optical path, and the control unit controls the image forming unit based on a detection of a transmission of the light by the first detecting unit.

2. The image forming apparatus according to claim 1, wherein the first housing units house the coloring materials corresponding to colors including Y (yellow), M (magenta), C (cyan), and K (black), and the second housing units house the coloring materials corresponding to colors including Y (yellow), M (magenta), C (cyan), and K (black).

3. The image forming apparatus according to claim 1, wherein the second detecting unit includes a detection device that detects a mixed state of the first housing units and the second housing units by a wired or a wireless communication when the transmission of the light is not detected by the first detecting unit, and the control unit controls the image forming unit based on a detection result of the storing module by the detection device.

4. The image forming apparatus according to claim 1, wherein the first detecting unit includes:

a light emitting device that emits the light so that the light is incident to the optical path from the one end; and a light receiving module that receives the light output from the other end of the optical path.

5. The image forming apparatus according to claim 1, wherein one of the first housing units or one of the second housing units to be disposed on the one end of the arrangement includes a light emitting device that emits the light so that light is incident to the optical path of another one of first or second housing units adjacent to the one of the first housing unit or the one of the second housing units to be disposed on the one end of the arrangement, and wherein another one of the first housing units or another one of the second housing units to be disposed on the other end of the arrangement includes a light receiving device that receives the light output from the optical path of the another one of the first or second housing units adjacent to the another one of the first housing units or the another one of the second housing units to be disposed on the other end of the arrangement.

6. The image forming apparatus according to claim 1, wherein the optical path forming portion includes a path formed in a part of each of the first housing units or the second housing units for transmitting the light and a reflective member disposed in the path.

7. The image forming apparatus according to claim 1 wherein the optical path forming portion includes a first reflective member that is disposed on a part of each of the first housing units or the second housing units and a second reflective member that is disposed in the apparatus.

8. The image forming apparatus according to claim 1, wherein the first given number is four.

9. The image forming apparatus according to claim 1, wherein a total of the second given number and the third given number is the first given number.

* * * * *